US008833316B2

(12) United States Patent
Ono et al.

(10) Patent No.: US 8,833,316 B2
(45) Date of Patent: Sep. 16, 2014

(54) STRATIFIED SCAVENGING TWO-STROKE ENGINE

(75) Inventors: Ryou Ono, Sayama (JP); Mikihiro Asahina, Shiki (JP)

(73) Assignee: Husqvarna Zenoah Co., Ltd., Kawagoe-shi (JP)

( * ) Notice: Subject to any disclaimer, the term of this patent is extended or adjusted under 35 U.S.C. 154(b) by 0 days.

(21) Appl. No.: 13/980,428

(22) PCT Filed: Feb. 3, 2011

(86) PCT No.: PCT/JP2011/000611

§ 371 (c)(1),
(2), (4) Date: Jul. 18, 2013

(87) PCT Pub. No.: WO2012/104919

PCT Pub. Date: Aug. 9, 2012

(65) Prior Publication Data

US 2013/0291840 A1 Nov. 7, 2013

(51) Int. Cl.

| | |
|---|---|
| ***F02B 25/00*** | (2006.01) |
| ***F02B 33/04*** | (2006.01) |
| ***F02B 25/22*** | (2006.01) |
| ***F02B 25/20*** | (2006.01) |
| ***F02B 25/14*** | (2006.01) |
| ***F02B 33/00*** | (2006.01) |

(52) U.S. Cl.

CPC ..... *F02B 33/00* (2013.01); *F02B 33/04* (2013.01); *F02B 25/22* (2013.01); *F02B 25/20* (2013.01); *F02B 25/14* (2013.01)

USPC ..... 123/73 PP; 123/73 A

(58) Field of Classification Search

USPC ..... 123/73 PP, 73 A, 73 AA

See application file for complete search history.

(56) References Cited

U.S. PATENT DOCUMENTS

| | | | |
|---|---|---|---|
| 3,815,558 | A | 6/1974 | Tenney |
| 2002/0104493 | A1 | 8/2002 | Fukuoka et al. |

FOREIGN PATENT DOCUMENTS

| | | | |
|---|---|---|---|
| EP | 1482146 | A2 | 12/2004 |
| EP | 2278137 | A2 | 1/2011 |

(Continued)

OTHER PUBLICATIONS

International Search Report and Written Opinion of PCT/JP2011/000611 mailed Nov. 18, 2011.

(Continued)

*Primary Examiner* — Noah Kamen

(74) *Attorney, Agent, or Firm* — Nelson Mullins Riley & Scarborough LLP

(57) ABSTRACT

A stratified scavenging two-stroke engine includes: a crankcase (2); a cylinder (3) being provided with a cylinder bore (31); an intake passage (4) supplying air-fuel mixture into the crankcase (2) via an intake port (4A); a scavenging passage (5) supplying the air-fuel mixture from the crankcase (2) into the cylinder bore (31) via a scavenging port (5A); a leading-air passage (6) supplying leading air into the scavenging passage (5); and an exhaust passage (7) being disposed on an opposite side of the intake passage (4) with the cylinder bore (31) interposed therebetween, the exhaust passage (7) discharging exhaust gas via an exhaust port, in which the scavenging passage (5) includes a main passage (51) provided near the exhaust port and a sub passage (52) provided near the intake port (4A), the main passage (51) and the sub passage (52) are isolated from each other by a partition (25, 34) that extends over substantially an entire length of the main passage (51) and the sub passage (52), the sub passage (52) includes an air-fuel mixture inlet (55) provided at a position corresponding to an opening end (35) of the cylinder bore (31) that faces the crankcase (2), and the inlet (55) functions as a flow rate adjuster having a throttle effect.

1 Claim, 5 Drawing Sheets

(56) References Cited

FOREIGN PATENT DOCUMENTS

| | | | |
|---|---|---|---|
| JP | 11315722 | A | 11/1999 |
| JP | 2008138602 | A | 6/2008 |
| WO | 2009078452 | A1 | 6/2009 |

OTHER PUBLICATIONS

Chapter I International Preliminary Report on Patentability of PCT/JP2011/000611 mailed Aug. 6, 2013.

STRATIFIED SCAVENGING TWO-STROKE ENGINE

TECHNICAL FIELD

The present invention relates to a stratified scavenging two-stroke engine.

BACKGROUND ART

There has been typically known a stratified scavenging two-stroke engine in which leading air is fed into a scavenging passage through a scavenging port (i.e., an opening of the scavenging passage that is opened in a combustion chamber), and the leading air is initially supplied to the combustion chamber through the scavenging passage prior to air-fuel mixture for scavenging, thereby suppressing blow-by of the air-fuel mixture.

In such a stratified scavenging stroke engine, there has been suggested that the scavenging passage include a main passage defined near an exhaust port and a sub passage defined near an intake port and a throttle as a flow rate adjuster be provided in the middle of the sub passage to reduce the inflow energy of the air-fuel mixture entering the combustion chamber, thereby suppressing the blow-by of the air-fuel mixture during the scavenging process (Patent Literature 1).

CITATION LIST

Patent Literature

Patent Literature 1: JP-A-2008-138602

SUMMARY OF INVENTION

Technical Problem

The throttle of Patent Literature 1 is provided near a cylinder, so that the throttle is close to the scavenging port where the leading air enters. Thus, since a sufficient amount of the leading air cannot be fed into the scavenging passage, the blow-by of the air-fuel mixture may not be reliably suppressed.

An object of the invention is to provide a stratified scavenging two-stroke engine capable of ensuring a sufficient feeding amount of leading air to further reliably prevent blow-by of air-fuel mixture irrespective of formation of a flow rate adjuster such as a throttle in a scavenging passage.

Solution to Problem

According to a first aspect of the invention, a stratified scavenging two-stroke engine includes: a crankcase; a cylinder being provided with a cylinder bore; an intake passage supplying air-fuel mixture into the crankcase via an intake port; a scavenging passage supplying the air-fuel mixture from the crankcase into the cylinder bore (i.e., a combustion chamber in the cylinder bore) via a scavenging port; a leading-air passage supplying leading air into the scavenging passage; and an exhaust passage being disposed on an opposite side of the intake passage with the cylinder bore interposed therebetween, the exhaust passage discharging exhaust gas via an exhaust port, in which the scavenging passage includes a main passage provided near the exhaust port and a sub passage provided near the intake port, the main passage and the sub passage are isolated from each other by a partition that extends over substantially an entire length of the main passage and the sub passage, the sub passage includes an air-fuel mixture inlet provided at a position corresponding to an opening end of the cylinder bore that faces the crankcase, and the inlet functions as a flow rate adjuster.

With the above arrangement, while the sub passage is so long as to extend from the vicinity of the opening end of the cylinder bore to the scavenging port, the inlet of the sub passage serves as the flow rate adjustor, so that a large amount of leading air can be fed through the entire length of this long scavenging passage. The large amount of leading air is supplied to the combustion chamber disposed near the scavenging port prior to the air-fuel mixture whose flow rate is controlled by the flow rate adjustor, so that exhaust gas can be scavenged while blow-by of the air-fuel mixture is reliably suppressed.

In a stratified scavenging two-stroke engine according to a second aspect of the invention, the cylinder and the crankcase are provided by separate bodies that are coupled to each other, the opening end of the cylinder bore is formed in a cylindrical skirt that is inserted into the crankcase, a vicinity of the inlet of the sub passage is defined by a part of an outer circumference of the skirt, the partition, an inner wall of the crankcase spaced from the part of the skirt, and a closure extending from the inner wall toward the skirt, the inlet is provided by a clearance having a predetermined width formed between a peripheral edge of the closure and the outer circumference of the skirt.

With the above arrangement, since a part of the skirt of the cylinder is used to define the inlet of the sub passage and the vicinity thereof. With the crankcase provided with the partition and the closure, the inlet can be provided by a clearance defined between the partition and closure and the skirt. The clearance is necessarily formed in order to insert the skirt into the crankcase during assembling. The use of such a necessarily-formed clearance results in a simplified structure and a reduced production cost.

DESCRIPTION OF EMBODIMENTS

An exemplary embodiment of the invention will be described below with reference to the drawings.

Figure 1:
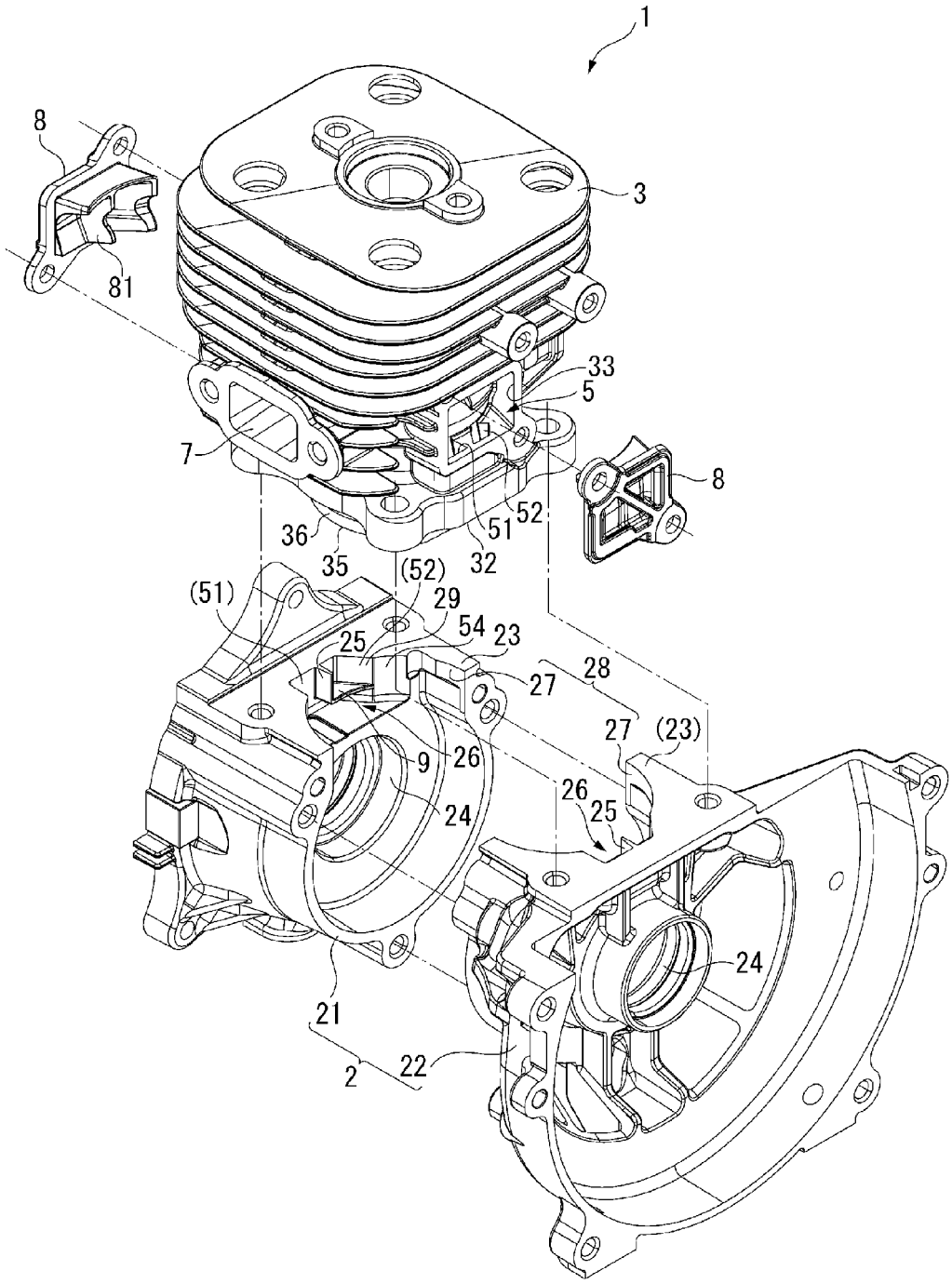
FIG. 1 is an exploded perspective view showing an entire stratified scavenging two-stroke engine according to an exemplary embodiment of the invention.
Figure 2:
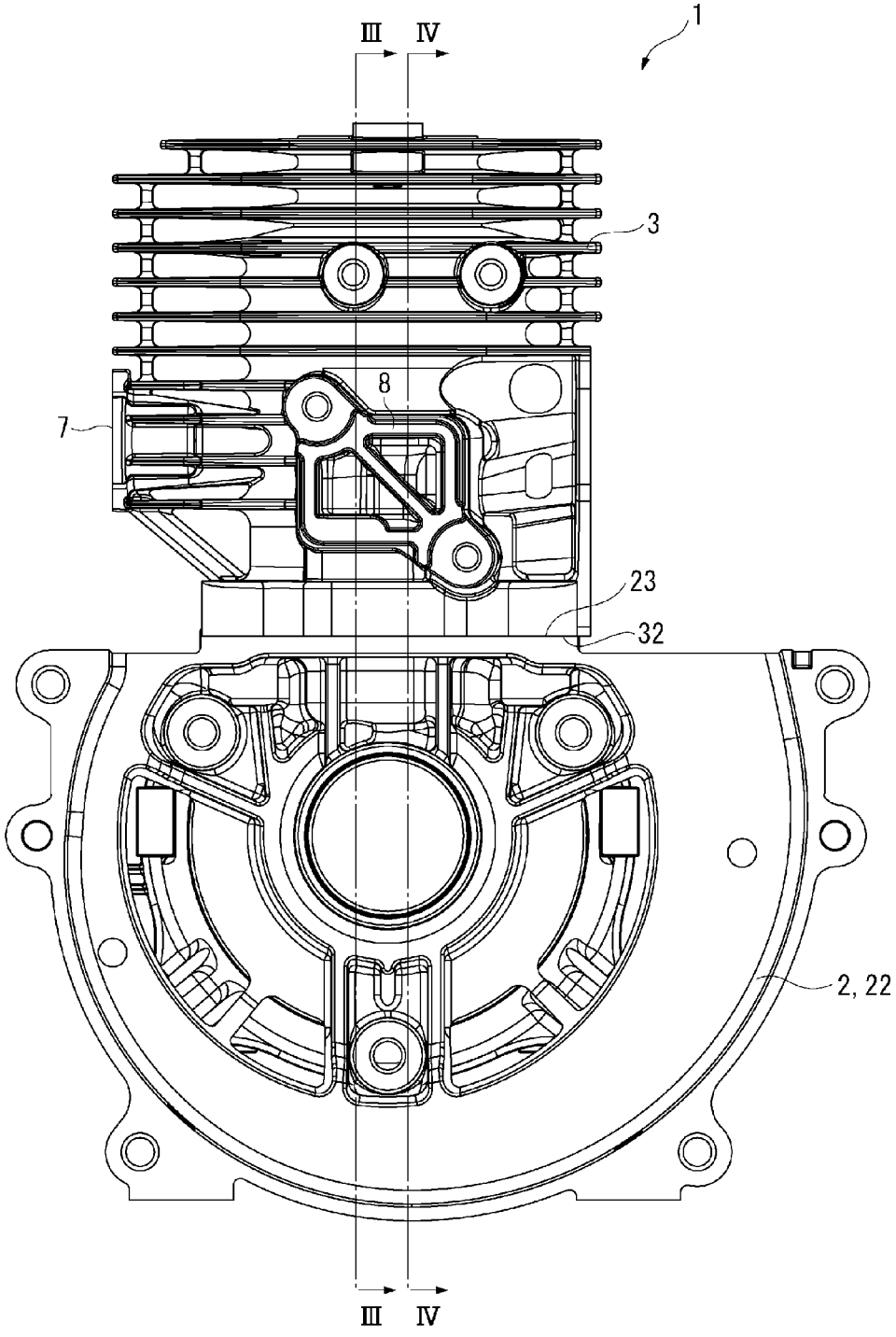
FIG. 2 is a front view showing the stratified scavenging two-stroke engine.

Referring to FIGS. 1 and 2, a stratified scavenging two-stroke engine (hereinafter referred to simply as an engine) 1 according to this exemplary embodiment includes: a halved-type crankcase 2 including a pair of cases 21 and 22; and a cylinder 3 coupled to a flattened attachment surface 23 defined on the crankcase 2 via a gasket.

A crankshaft (not shown) is disposed in the inner space of the crankcase 2, while a piston (not shown) is slidably disposed in a cylinder bore 31 of the cylinder 3. The piston and the crankshaft are coupled to each other using a connecting rod. Both ends of the crankshaft are rotatably supported by bearings held by respective cylindrical bearing holders 24 of the cases 21 and 22.

On the lateral side of the cylinder 3, an intake passage 4 (FIGS. 2 and 3) that feeds air-fuel mixture into the crankcase 2 and leading-air passages 6 that feed leading air into a pair of scavenging passages 5 (FIGS. 2 and 3) are formed. Likewise, an exhaust passage 7 is provided on the opposite side of the intake passage 4 across the cylinder bore 31.

Figure 3:
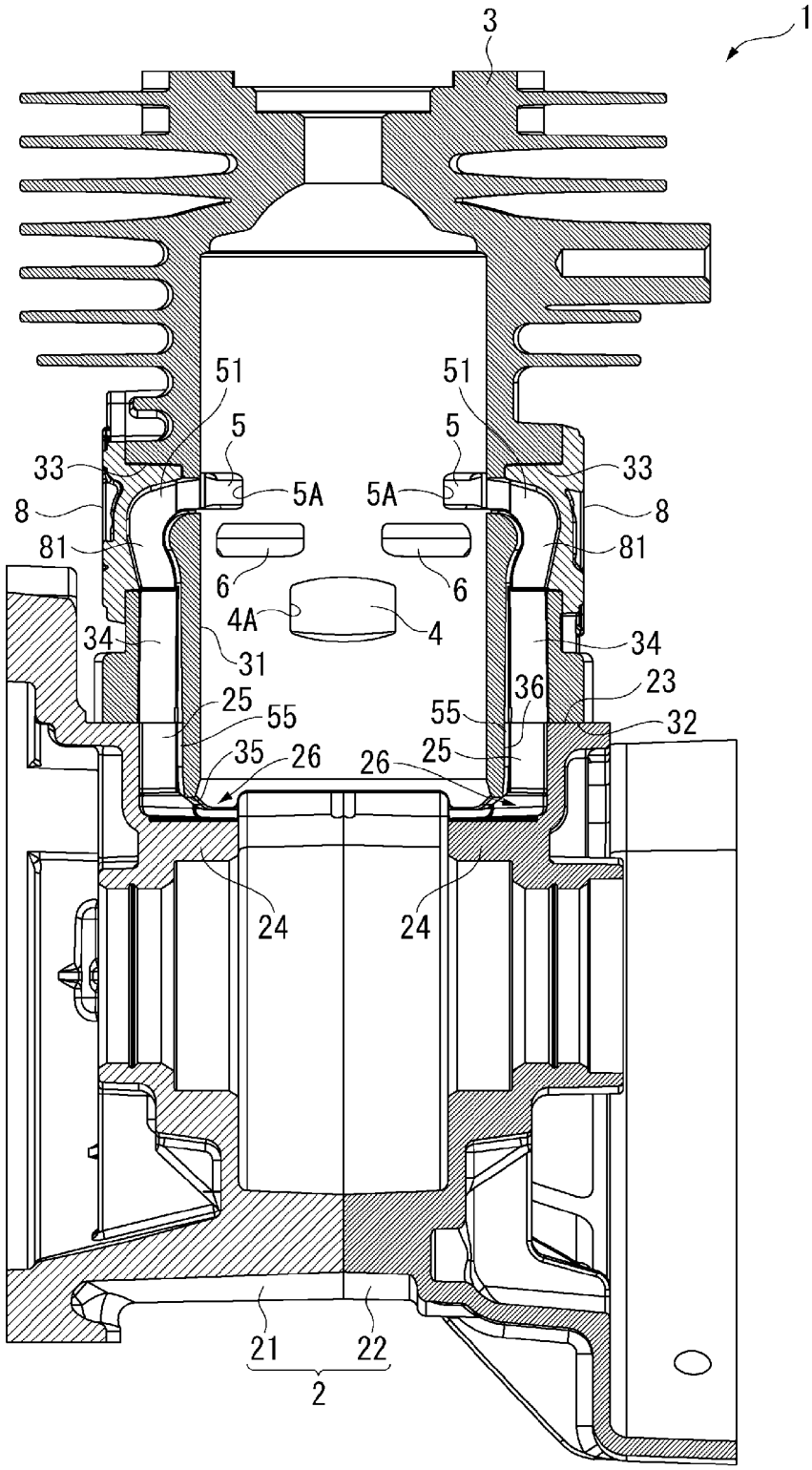
FIG. 3 is a view on arrow III-III in FIG. 2 for showing a sectional view of the stratified scavenging two-stroke engine.
Figure 4:
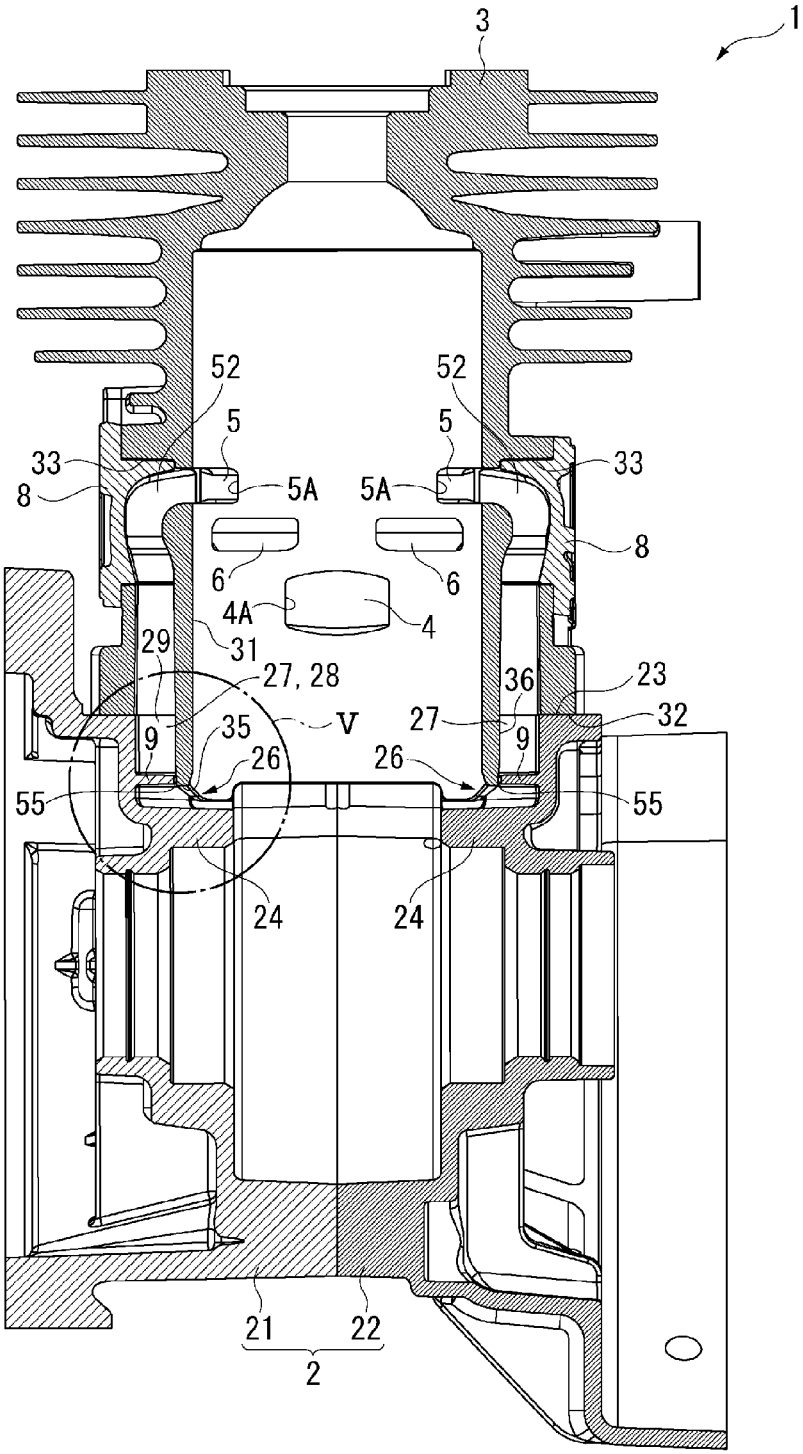
FIG. 4 is a view on arrow IV-IV in FIG. 2 for showing a sectional view of the stratified scavenging two-stroke engine.

As shown in FIGS. 2 and 3, the intake passage 4 includes an intake port 4A that is opened and closed in accordance with the vertical movement (in the Figure) of the piston. When the piston is moved upward, the intake port 4A is opened and negative pressure is generated in the crankcase 2, so that the air-fuel mixture is sucked into the crankcase 2. The outer circumference of the piston is provided with a pair of recesses for communicating the leading-air passages 6 and the scavenging passages 5 in conjunction with the upward movement of the piston. The leading air is fed from the leading-air passages 6 into the scavenging passages 5 through the scavenging ports 5A via the recesses.

When the piston is moved downward and the scavenging ports 5A are opened, the air-fuel mixture fed in the crankcase 2 is supplied to a combustion chamber defined in the cylinder bore 31 through the scavenging passages 5. At this time, the leading air, being fed beforehand in the scavenging passages 5 near the scavenging ports 5A, is initially fed to the combustion chamber and is directed to an unshown exhaust port (toward a blow-by side), thereby suppressing blow-by of the air-fuel mixture from the exhaust port along with exhaust gas.

Referring to FIGS. 1 to 3, the scavenging passages 5 are provided at two positions that are opposite in the radial direction of the cylinder 3 and are shifted relative to the intake passage 4 and the exhaust passage 7 by approximately 90 degrees. Each of the scavenging passages 5 extends across the boundary between the crankcase 2 and the cylinder 3 while being continuous via an opening corresponding to the attachment surface 23 of the crankcase 2 and a contact surface 32 of the cylinder 3.

In this exemplary embodiment, on the lateral side of the cylinder 3, openings 33 for communicating the inside and outside of the cylinder 3 are formed. In the cylinder 3, the scavenging passages 5 are provided by the inner spaces of the openings 33, to which covers 8 are fitted from the outside to close the openings 33.

The inner surface of each of the covers 8 (i.e., the surfaces facing the scavenging passages 5) is provided with a fin-like cover-side partition 81 that protrudes toward the inside of the cylinder 3. Each of the scavenging passages 5 of this exemplary embodiment is divided by the cover-side partition 81 into a main passage 51 with a large passage area disposed near the exhaust port and a sub passage area 52 with a small passage area disposed near the intake port 4A. The passages 51 and 52 are isolated from each other by the cover-side partition 81 and the recesses of the piston are opened in the sub passage 52, so that the leading air entering through the recesses is restrained from flowing into the main passage 51 by the cover-side partition 81, and thus, a larger amount of the leading air is fed in the sub passage 52 disposed near the intake port 4A. Since the sub passage 52 is narrowed to have its passage area reduced, the air-fuel mixture whose flow rate is controlled is fed through the sub passage 52.

The cover-side partition 81 is set continuous with a cylinder-side partition 34 that extends from the opening 33 to the contact surface 32 in the cylinder 3, and is set continuous with a crankcase-side partition 25 that extends from the attachment surface 23 to the upper portion of the holder 24 in the crankcase 2. As a result, the scavenging passage 5 is divided into the passages 51 and 52 by the partitions 25, 34 and 81 over substantially the entire length thereof.

Specifically, the scavenging passage 5 in the crankcase 2 is present in a mixture intake 26 that is sunken from the attachment surface 23 toward the holder 24, and the crankcase-side partition 25 divides the scavenging passage 5. Thus, the air-fuel mixture in the crankcase 2 is fed into the scavenging passage 5 via the mixture intake 26. The inner space of the crankcase 2 is allowed to communicate with the inner space of the cylinder 3 via an insertion hole 28 provided by fitting respective semicircular openings 27 of the cases 21 and 22 together. A cylindrical skirt 36, which is inserted in the insertion hole 28, forms an opening end 35 of the cylinder bore 31.

The mixture intake 26 of the crankcase 2, in particular, the vicinity of the inlet 55 provided to the end of the sub passage 52, is defined by a part of the outer circumference of the skirt 36, the crankcase-side partition 25, an inner wall 29 of the mixture intake 26 spaced from the part of the skirt 36, and a closure 9 extending from the inner wall 29 of the mixture intake 26 toward the skirt 36.

The closure 9 is also set continuous with the crankcase-side partition 25, so that the closure 9 and the crankcase-side partition 25 form an L-shaped peripheral edge. Such a peripheral edge and an inner wall 54 that is adjacent to the inner wall 29 are close to the skirt 36 at a predetermined clearance.

Figure 5:
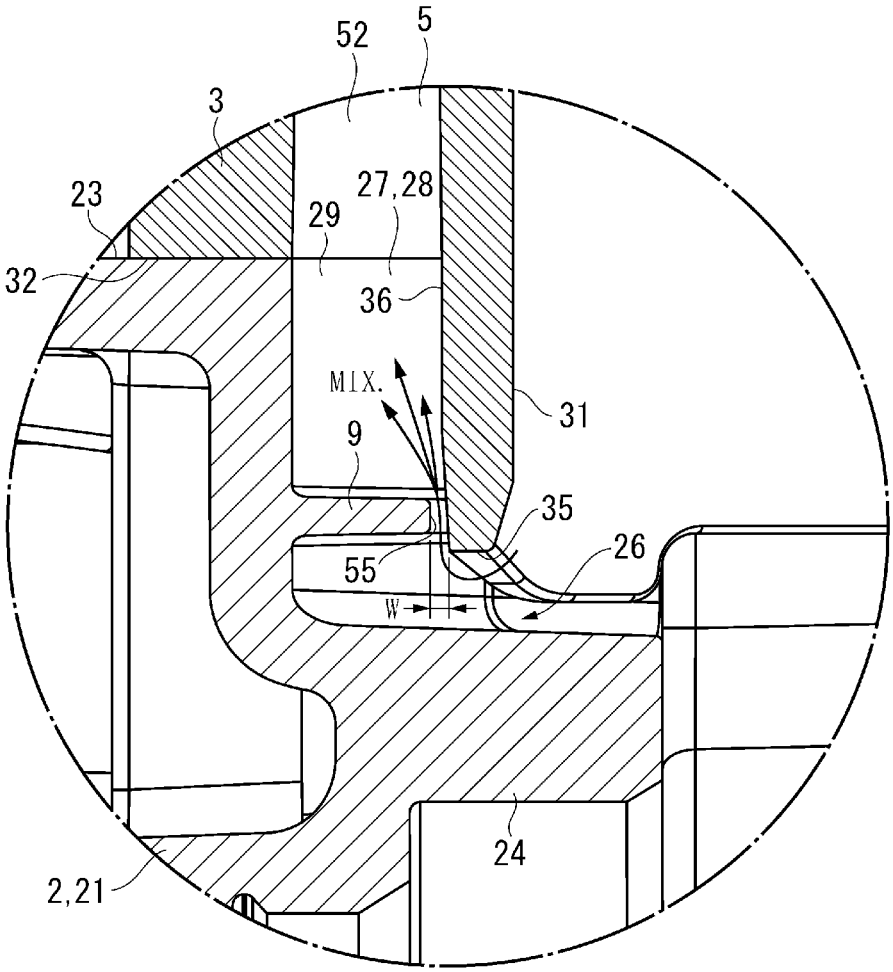
FIG. 5 is an enlarged view showing a portion surrounded by a surrounding circle V in FIG. 4.

FIG. 5 shows an enlarged view of a portion including the closure 9 and the skirt 36. The position of the closure 9 and the opening end 35 of the cylinder bore 31 substantially correspond to each other. Specifically, in this exemplary embodiment, the main passage 51 is also formed over an extent from the opening end 35 of the cylinder bore 31 to the scavenging port 5A in the same manner as the sub passage 52 narrowed by the closure 9.

A clearance between the distal end of the closure 9 and the outer circumference of the skirt 36 forms an inlet 55 having a clearance width W. The inlet 55 having the clearance width W continuously extends over not only a portion between the crankcase-side partition 25 and the skirt 36 but also a portion between the skirt 36 and the inner wall 54. The clearance width W depends on an engine size.

With the above exemplary embodiment, the main passage 51 and the sub passage 52 are designed to be long enough to extend from the opening end 35 of the cylinder bore 31 facing the crankcase 2 to the scavenging port 5A, thereby ensuring a larger amount of leading air fed into the sub passage 52 as compared with a conventional arrangement.

Further, in particular, the inlet 55 of the sub passage 52 and the vicinity thereof are narrowed by the closure 9 so as to close the vicinity of the inlet 55, thereby allowing the inlet 55 to have a throttle effect. In other words, the inlet 55 narrowed by the closure 9 functions as a flow rate adjuster of the invention. Thus, the flow rate of the air-fuel mixture can be optimally adjusted through the inlet 55 of the sub passage 52 and the air-fuel mixture can be fed into the combustion chamber near the intake port 4A, so that exhaust gas can be reliably scavenged with the large amount of leading air, thereby further reliably suppressing blow-by of the air-fuel mixture.

Note that the best arrangement, process and the like for implementing the invention have been disclosed in the above description but the scope of the invention is not limited thereto.

For instance, while the inlet 55 having a narrow width formed between the closure 9 and the skirt 36 functions as the flow rate adjuster in the above exemplary embodiment, when the sub passage 52 is formed in the crankcase 2 without using a part of the skirt 36 (i.e., when the sub passage 52 is formed in a cylindrical shape, for instance), an opening (such as a hole or a cutout) having a predetermined dimension may be provided on the closure 9, the opening functioning as a throttle as the flow rate adjuster of the invention.

Although the leading-air passage 6 and the scavenging passage 5 communicate with each other via the recesses of the piston in the above exemplary embodiment, the leading-air passage may be formed on the outer circumference of the cylinder in such a manner as to extend around the cylinder bore, so that the leading-air passage directly communicate with the scavenging passage.

INDUSTRIAL APPLICABILITY

The invention is applicable as a stratified scavenging two-stroke engine installed on a portable work machine such as a brushcutter, a chainsaw, an engine blower or a hedge trimmer.

REFERENCE SIGNS LIST

1 . . . stratified scavenging two-stroke engine
2 . . . crankcase
3 . . . cylinder
4A . . . intake port
5 . . . scavenging passage
5A . . . scavenging port
9 . . . closure
25 . . . partition (crankcase-side partition)
31 . . . cylinder bore
34 . . . partition (cylinder-side partition)
35 . . . opening end
36 . . . skirt
51 . . . main passage
52 . . . sub passage
55 . . . inlet
81 . . . partition (cover-side partition)
W . . . clearance width

The invention claimed is:

1. A stratified scavenging two-stroke engine comprising:

a crankcase;

a cylinder having a cylinder bore;

an intake passage supplying air-fuel mixture into the crankcase via an intake port;

a scavenging passage supplying the air-fuel mixture from the crankcase into the cylinder bore via a scavenging port;

a leading-air passage supplying leading air into the scavenging passage; and an exhaust passage being disposed on an opposite side of the intake passage with the cylinder bore interposed therebetween, the exhaust passage discharging exhaust gas via an exhaust port, wherein the scavenging passage includes a main passage provided near the exhaust port and a sub passage provided near the intake port, the main passage and the sub passage are isolated from each other by a partition that extends over substantially an entire length of the main passage and the sub passage, the sub passage includes an air-fuel mixture inlet provided at a position corresponding to an opening end of the cylinder bore that faces the crankcase, and the inlet functions as a flow rate adjuster, and wherein the cylinder and the crankcase are provided by separate bodies that are coupled to each other, the opening end of the cylinder bore is formed in a cylindrical skirt that is inserted into the crankcase, a vicinity of the inlet of the sub passage is defined by a part of an outer circumference of the skirt, the partition, an inner wall of the crankcase spaced from the part of the skirt, and a closure extending from the inner wall toward the skirt, the inlet is provided by a clearance having a predetermined width formed between a peripheral edge of the closure and the outer circumference of the skirt.

* * * * *